United States Patent [19]

Matthey et al.

[11] 4,261,273

[45] Apr. 14, 1981

[54] PNEUMATIC SPEED CONTROL FOR AN ELECTRIC SEWING MACHINE

[75] Inventors: Jacques Matthey, Geneva; Marcel Torre, Meyrin-Geneva, both of Switzerland

[73] Assignee: Mefina S.A., Fribourg, Switzerland

[21] Appl. No.: 862,981

[22] Filed: Dec. 21, 1977

[30] Foreign Application Priority Data

Dec. 29, 1976 [CH] Switzerland ..... 16426/76

[51] Int. Cl.[3] ..... D05B 69/10; D05B 69/14

[52] U.S. Cl. ..... 112/277; 112/220

[58] Field of Search ..... 112/277, 220, DIG. 3, 112/158 C–158 F, 258, 276; 200/86.5, 81 H, 83 Z; 318/345 H, 345 D, 345 G, 345 C

[56] References Cited

U.S. PATENT DOCUMENTS

| | | | |
|---|---|---|---|
| Re. 26,836 | 3/1970 | Myers | 112/220 |
| 2,562,847 | 7/1951 | Spencer | 200/81 H X |
| 2,604,862 | 7/1952 | Merson et al. | 112/258 X |
| 2,706,956 | 4/1955 | Peets et al. | 112/258 X |
| 2,739,552 | 3/1956 | Sailer | 112/220 |
| 2,833,235 | 5/1958 | Smellie | 112/227 |
| 2,977,523 | 3/1961 | Cockrell | 112/220 X |
| 3,156,204 | 11/1964 | Harnish et al. | 112/DIG. 3 |
| 3,253,874 | 5/1966 | Czech | 112/258 X |
| 3,302,088 | 1/1967 | Wigington | 112/277 X |
| 3,364,452 | 1/1968 | Thompson et al. | 112/277 X |
| 3,402,338 | 9/1968 | Thoresen | 318/345 D X |
| 3,564,372 | 2/1971 | Vogelsberg et al. | 38/345 H |
| 3,634,874 | 1/1972 | Mason | 318/345 H |
| 3,665,872 | 5/1972 | Hodgins | 112/277 X |
| 3,671,694 | 6/1972 | Masuda | 200/83 Z |
| 3,789,783 | 2/1974 | Cook et al. | 112/220 |
| 3,950,814 | 4/1976 | Fleischhauer | 200/83 Z |
| 4,052,946 | 10/1977 | Rydz et al. | 112/158 E |

FOREIGN PATENT DOCUMENTS

| | | | |
|---|---|---|---|
| 225810 | 3/1968 | Sweden | 112/220 |
| 989691 | 4/1965 | United Kingdom | 112/276 |
| 1299432 | 12/1972 | United Kingdom | 200/81 H |

*Primary Examiner*—Werner H. Schroeder
*Assistant Examiner*—Andrew M. Falik
*Attorney, Agent, or Firm*—Emory L. Groff, Jr.

[57] ABSTRACT

A motor controller for an electric sewing machine mounted in a removable portion of the housing of the machine. The controller is actuatable by a pneumatic switch which successively closes a plurality of contacts as the air pressure to the switch is increased to enable the speed of the motor to be increased smoothly and gradually without sparking at the contacts.

7 Claims, 6 Drawing Figures

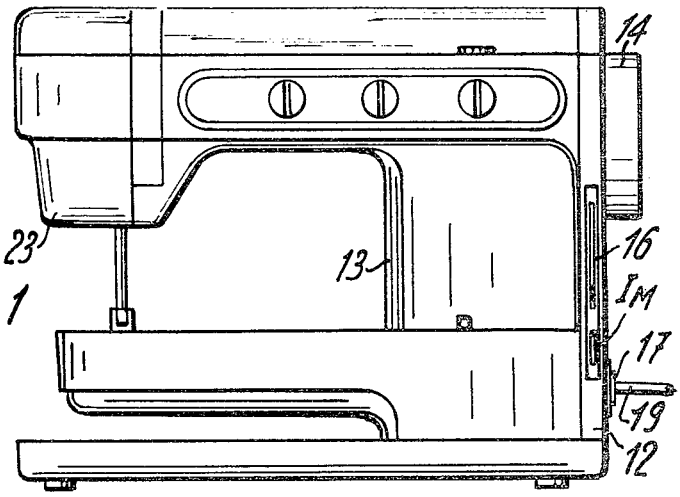
FIG. 1
FIG. 5
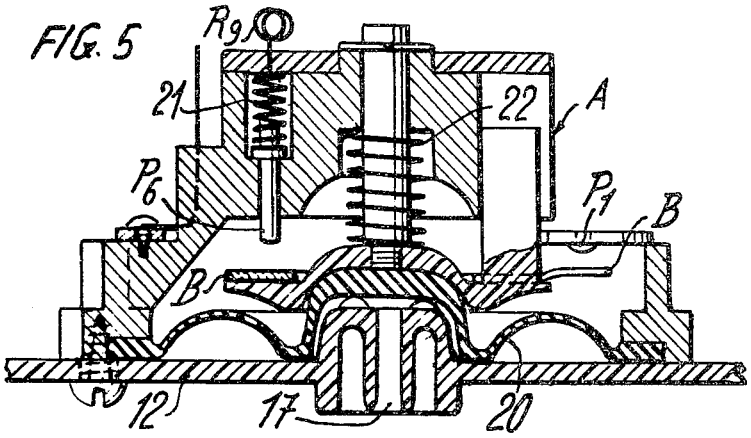
FIG. 4
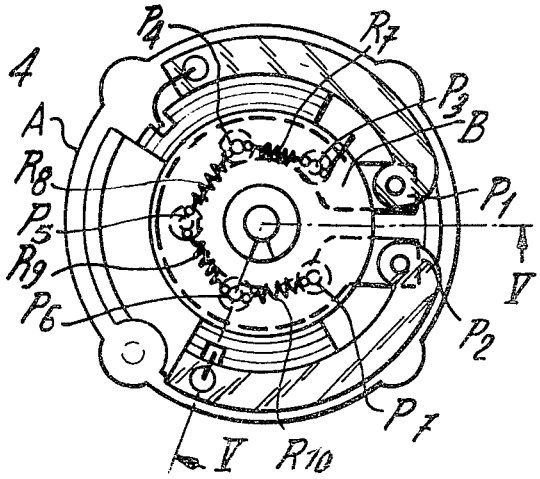
FIG. 5A
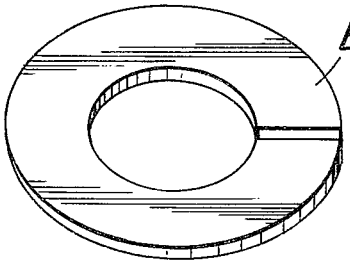

PNEUMATIC SPEED CONTROL FOR AN ELECTRIC SEWING MACHINE

The present invention concerns a device for controlling the motor of an electric sewing machine.

In known electric sewing machines, various parts of the device controlling the motor are generally mounted one by one in the machine and connected together during assembly. Other members of this control device, particularly a rheostat making it possible to control the speed of the motor, are mounted in a control pedal connected to the machine by an electrical lead.

According to the present invention, there is provided a device for controlling the motor of a sewing machine comprising an electronic regulator mounted in a removable part of the housing of the machine.

The present invention will now be described further, by way of example, with reference to the accompanying drawings, in which:

FIG. 1 is an elevational view of a sewing machine including a control device;

FIG. 4 is a partial plan view of a pneumatic control member of the control circuit shown in FIG. 3; and FIG. 5 is a cross sectional view taken on the line V—V of FIG. 4 of the control member shown in FIG. 4.

FIG. 5A is a perspective view of a modified form of contact plate.

Figure 2:
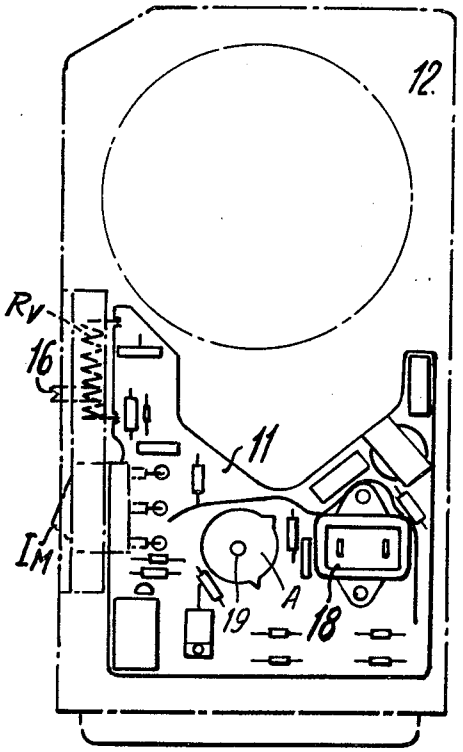
FIG. 2 is an elevational view of the control device for the machine shown in FIG. 1.

As shown in FIG. 2, an electronic regulator is disposed on a support 11 removably mounted in a closure cover 12 of the housing 13 of the machine, below the flywheel 14 thereof.

The cover 12 carries a circuit breaker $I_M$ including a luminous indicator energised by the voltage of the strong output current of the regulator through a protection resistor $R_2$ (see FIG. 3) preventing premature operation of the sewing machine during the engagement of the circuit breaker $I_M$, and in the event of a breakdown of one of the components. The cover 12 also carries a slider 16 of a variable resistor $R_v$, on its edge located adjacent the front side of the housing 13 of the machine, and also a connecting socket 18. As will be seen later, the slider 16 makes it possible to indicate the maximum desired speed of the motor, whilst this maximum speed may be adjusted by means of the variable resistor $R_v$.

Figure 3:
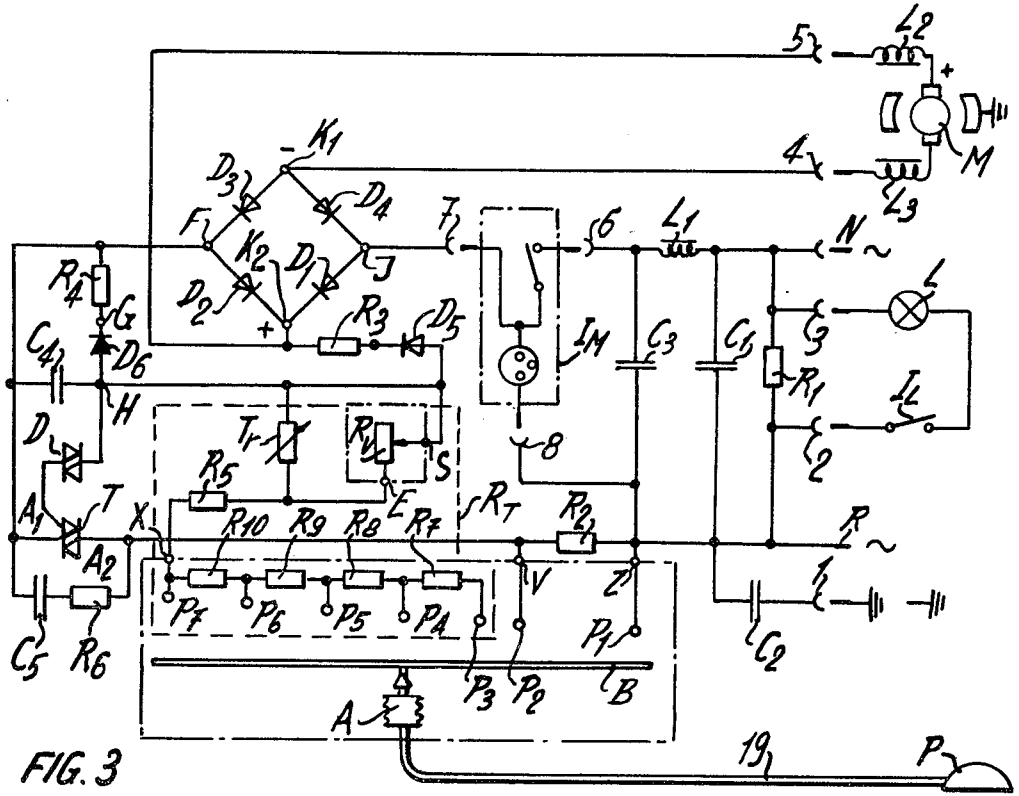
FIG. 3 is a circuit diagram for controlling the motor of the machine shown in FIG. 1.

The energising of the motor and the control of its speed until the maximum speed indicated by the slider 16, are achieved by means of a pneumatic control member A mounted in the cover 12 and connected to a pneumatic actuating pedal P shown schematically in FIG. 3.

This pneumatic control member shown in FIGS. 4 and 5 comprises an inlet 17, accessible from the outside of the sewing machine and connected by a flexible tube 19 to the pedal P. A diaphragm 20, when subjected to air pressure by actuation of the pedal P, displaces a contact bar B into contact with a terminal $P_1$ and then a terminal $P_2$ to short-circuit the protecting resistor $R_2$, thus ensuring the energising of the circuit of the motor M.

As shown in FIGS. 4 and 5, the contact bar B is formed by an annular plate supported on the diaphragm 20. The terminals $P_1$ and $P_2$ for energising the motor circuit and further terminals $P_3$ to $P_4$, for short-circuiting resistors $R_7$ to $R_{10}$ of the control circuit, are disposed opposite the annular plate B at distances increasing therefrom. The resistors $R_7$ to $R_{10}$ are disposed in an arc of a circle in the same plane, and the terminals $P_3$ to $P_6$ are connected to these resistors $R_7$ to $R_{10}$ by conductors 21 wound in a spiral and forming, in fact, return springs. Hence, after ensuring the energising of the motor circuit by the short-circuiting of the resistor $R_2$, the control circuit is energised when B comes into contact with the terminal $P_3$ and short-circuits in succession the resistors $R_7$, $R_8$, $R_9$ and $R_{10}$ by displacing the contact terminals $P_4$ to $P_7$ in turn against the action of the return springs 21. A central spring 22 is intended to return the plate B towards its rest position as soon as pressure on the pedal P is reduced.

In a modification, it would be possible, for example, to arrange the terminals $P_3$ to $P_7$ on an arc of a circle in the same plane and to establish contact with the annular plate B by means of contact fingers of decreasing length provided in an arc on a contact disc of the plate B.

The annular shape of the plate B and the arrangement of the resistors $R_7$ to $R_{10}$ and their terminals $P_3$ to $P_7$ in an arc makes it possible to provide a particularly compact pneumatic control member.

Many other modifications could still be incorporated. For example, as shown in FIG. 5A, it would be possible to provide the plate B in the form of a helically shaped plate B' engageable with the terminals $P_1$ to $P_7$ arranged on the same plane and against which this helical plate would be progressively pressed by the diaphragm 20 when the latter is subjected to pressure by actuation of the pedal P.

The operation of the controller will be explained with reference to the diagram of the control circuit of the machine shown in FIG. 3.

As illuminating lamp L in series with a switch $I_L$ mounted in the head 23 of the machine is connected by the supply terminals R and N. This circuit is independent of the circuit for controlling the motor M which is separately energised by permanent magnets operating under rectified current. The motor M is connected via terminals 4 and 5 to two output terminals, $K_1$ negative, $K_2$ positive, of a bridge rectifier comprising four diodes D1, D2, D3 and D4.

One of the other inputs J of the rectifier is connected to the terminal N via the circuit breaker $I_M$ and by suppressor coil $L_1$. The other input F of the rectifier is connected to the terminal R via a triac T and the resistor $R_2$. The control electrode of the triac T is connected to a terminal H of a capacitor $C_4$ via a diac D, and the other terminal of capacitor $C_4$ is connected to the terminal F of the rectifier.

A diode $D_6$ and a resistor $R_4$, in series with the diode $D_6$, are connected in parallel with the capacitor $C_4$, the anode of the diode $D_6$ being connected to the terminal H.

The potential applied to the terminal H is determined by the capacitor $C_4$ and by a network $R_T$ of resistors. This network comprises: starting from the terminal H, an adjustable resistor $T_r$ for compensating tolerances of the components; the variable resistor $R_v$ in parallel with the resistor $T_r$ and the slider 16 of which resistor $R_v$ is accessible from outside the sewing machine; a residual resistor $R_5$ for limiting a control current and in series with the resistors $T_r$ and $R_v$; and four resistors $R_{10}$, $R_9$, $R_8$ and $R_7$ in series, forming a rheostat and having the contact terminals $P_7$, $P_6$, $P_5$, $P_4$ and $P_3$. The terminals $P_3$ to $P_7$ are arranged so that they are contacted one after the other by the displaceable plate B under the action of the pneumatic member P, as mentioned above.

The terminal $P_3$ may be connected by means of the plate B and a terminal $P_1$ to the input terminal R. The terminal $P_2$, connected to the terminal R via the resistor $R_2$, is arranged to be contacted by the plate B when the plate B, having begun its displacement, has already contacted the terminal $P_1$, with the terminals $P_2$ to $P_7$ being contacted in succession in decreasing order of the total resistance $R_T$, this order being obviously reversed as the plate B returns to its rest position, shown in the drawings.

The control circuit also comprises a diode $D_5$ in series with a resistor $R_3$ connected between the terminal H and the positive terminal $K_2$ of the rectifier, the anode of the diode $D_5$ being connected to the terminal H.

The circuit also comprises a certain number of suppressors, such as a $\pi$-filter comprising the coil $L_1$ in series in the supply line N and two capacitors $C_3$ and $C_1$ connected respectively to each end of the coil $L_1$ and to the other supply terminal R. A suppressor capacitor $C_2$ is also connected between the terminal R and the earth of the motor. High frequency inductances $L_2$ and $L_3$ are provided on the supply lines of the motor.

An RC circuit, comprising a resistor R6 in series with a capacitor $C_5$, is connected in parallel with the triac T for protection of the triac T against excess voltages during operation.

A resistor $R_1$ is connected between the terminals R and N to ensure discharge of the capacitors $C_1$ and $C_3$ when the plug is disconnected.

Operation is as follows:

The sewing machine is assumed to be ready for use with the circuit breaker $I_M$ closed. For as long as the user does not press on the control member P, the plate B is in the position shown in FIG. 3, and the terminals $P_1$ to $P_7$ are free. The control circuit of the triac T is open.

As soon as the user presses the control member P, the plate B is displaced and comes firstly into contact with the terminal $P_1$, thus being subjected to mains supply voltage. Then the plate B comes into contact with the terminal $P_2$, short-circuiting the resistor $R_2$ and then the terminal $P_3$, thus supplying the control circuit of the triac T. This progressive manner of connecting and disconnecting the circuit is to avoid sparks on the contacts $P_1$ and $P_2$ which are sources of interference and would cause rapid wear of the contacts.

The control circuit of the triac T is therefore fed through the network $R_T$ of resistors, the total resistance being variable, the capacitor $C_4$ and the diac D. The starting angle of the triac depends on the rate of variation of the voltage on the terminals of the capacitor $C_4$.

The more the resistance $R_T$ diminishes, the more rapid is the charging of the capacitor $C_4$; the diac D, and consequently, the triac T will start more rapidly. The conducting time of the triac T will increase and the motor M will receive more power.

The diode $D_6$ and a careful choice of the resistor $R_4$ make it possible to start the motor at speeds as low as permitted by the frictional forces in the machine, which is a certain advantage relative to the bi-directional disengaging members with known alternating voltages which involve rapid and abrupt speed variations. During positive half cycle, the resistor $R_4$ limits the charge of the capacitor $C_4$, shunting some of the current into the return circuit, the diode $D_6$ being conductive so that the capacitor $C_4$ does not reach the positive control voltage of the diac. During negative half cycle, the diode $D_6$ is blocked and there is no shunting of current, so that the capacitor $C_4$ attains, at any given moment, the negative control voltage of the diac. The triac therefore conducts only during the negative half cycles for rather high values of $R_T$, thus permitting low speed operation of the motor.

The diode $D_5$ and the resistor $R_3$ associated with the electro-motive force delivered by the motor M during the non-conductive period of the triac T, form an efficient counter-reaction at low speeds. For a given adjustment of the speed of the motor, an increase in the resisting torque of the motor is translated into a reduction in the speed of the motor and a reduction in the electromotive force delivered by the motor during the non-conductive period of the triac T.

The electro-motive voltage appearing on the terminal $K_2$ is in opposition to the voltage appearing on the terminal H, so that, when there is a reduction in the electro-motive voltage, there is an increase in the shunting of the charging current of the capacitor $C_4$ through the members $D_5$ and $R_3$. The capacitor $C_4$ will be charged with a weaker voltage during positive half cycle and will reach the negative control voltage of the diac D more rapidly during the negative half cycle. The triac T will therefore be started more rapidly, its conducting time will be longer and the motor will receive more power. In a counter-reaction circuit, such as described, the electro-motive voltage delivered by a direct current motor with separate excitation by permanent magnets requires no amplification, due to its high value, contrary to known counter-reaction circuits.

The adjustable resistor $T_r$ is adjusted upon assembly so as to ensure a predetermined motor speed whatever the tolerances of the circuit components may be, when all the resistors $R_7$ to $R_{10}$ are short-circuited and the resistor $R_v$ is adjusted to its maximum value, corresponding to a minimal speed.

It is possible to connect the asymmetric circuit $R_4$, $D_6$ between other terminals of the control circuit, for example between the terminals H and E, selecting, of course, an adequate value for the resistor $R_4$. Similarly, the counter-reaction circuit $R_3$, $D_5$ could be connected, for example, between the terminals H and J or H and $K_1$.

We claim:

1. In a sewing machine driven by an electric motor and having a housing for the mechanical parts of the machine, including a removable closure cover mounted on one side of the housing, the improvement comprising a device for controlling the motor including an electronic regulator mounted in said cover, said regulator connected to a pneumatic control member comprising an inlet accessible from outside the machine and a diaphragm which, when subjected to pressure, displaces a contact member towards terminals of a supply circuit of the motor of the machine in order to energize the circuit, said contact member comprising a plate of annular shape bearing against said diaphragm, said terminals disposed opposite said plate at increasing distances, conduits forming elastic return members and connecting said terminals to the circuit of the motor, whereby a defective controlling device may be replaced by merely removing the cover and substituting a cover with an operable controlling device.

2. A device according to claim 1, in which the contact member is a helically shaped plate, located opposite terminals of the power supply circuit of the motor, disposed in a circle, the plate having a diameter corresponding to that of the said circle, one of its ends bearing on the diaphragm which presses it progressively against the said terminals when it is subjected to pressure.

3. A device according to claim 1, in which the motor is a direct current motor with separate excitation by permanent magnets, and comprising a bridge rectifier having one branch for supplying the motor with direct current, a control assembly comprising a triac and a control circuit for the triac in the other branch of the bridge rectifier, the starting angle of the triac being determined by a capacitor connected in series with a resistance network, said electronic regulator comprising a variable resistor operable from outside the machine by means of a control member, this resistor being connected in such manner as to determine the maximum speed of the motor.

4. A device according to claim 3, in which the control assembly comprises a diode in series with a resistor, connected so as to create asymmetry of the charging current of the capacitor, said asymmetrical elements formed by the diode in series with the resistor being connected in parallel with the capacitor.

5. A device according to claim 3, in which the control assembly comprises a counter-reaction circuit comprising a diode in series with the resistor controlled by an electro-motive non-amplifier voltage delivered by the motor, said capacitor being connected to one of terminals of the bridge rectifier, and a resistor being connected between the positive terminal of the bridge rectifier and the common point of the capacitor and the resistance network.

6. A device according to claim 1, including a protection circuit arranged in such manner as to prevent premature starting of the motor, and comprising a resistor in series in the supply line, two terminals of this resistor being capable of being contacted in succession by the contact member for enabling connection or disconnection of the control circuit without any arcing of the said terminals.

7. In a sewing machine driven by an electric motor and having a housing for the mechanical parts of the machine, including a removable closure cover mounted on one side of the housing, the improvement comprising a device for controlling the motor including an electronic regulator mounted in said cover, said regulator connected to a pneumatic control member comprising an inlet accessible from outside the machine and a diaphragm which, when subjected to pressure, displaces a contact member towards terminals of a supply circuit of the motor of the machine in order to energize the circuit, a protection circuit arranged in such manner as to prevent premature starting of the motor, and comprising a resistor in series in the supply line, two terminals of said resistor being capable of being contacted in succession by said contact member for enabling connection or disconnection of the control circuit without any arcing of said terminals, whereby a defective controlling device may be replaced by merely removing the cover and substituting a cover with an operable controlling device.

* * * * *